US010901351B2

(12) United States Patent
Morihara et al.

(10) Patent No.: US 10,901,351 B2
(45) Date of Patent: Jan. 26, 2021

(54) IMAGE FORMING APPARATUS THAT CHANGES A CONTROL TARGET TEMPERATURE IN ACCORDANCE WITH A NUMBER OF SHEETS OF RECORDING MATERIAL THAT HAVE PASSED THROUGH AN IMAGE HEATING PORTION

(71) Applicant: CANON KABUSHIKI KAISHA, Tokyo (JP)

(72) Inventors: Ryo Morihara, Tokyo (JP); Masahiko Suzumi, Yokohama (JP); Tomoo Akizuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/715,363

(22) Filed: Dec. 16, 2019

(65) Prior Publication Data

US 2020/0192253 A1 Jun. 18, 2020

(30) Foreign Application Priority Data

Dec. 18, 2018 (JP) ..... 2018-236757

(51) Int. Cl.
*G03G 15/20* (2006.01)
*G03G 15/00* (2006.01)

(52) U.S. Cl.
CPC ..... *G03G 15/205* (2013.01); *G03G 15/2053* (2013.01); *G03G 15/505* (2013.01); *G03G 15/5045* (2013.01)

(58) Field of Classification Search
CPC ..... G03G 15/2039; G03G 15/205
USPC ..... 399/69
See application file for complete search history.

(56) References Cited

U.S. PATENT DOCUMENTS 10,558,143 B2 * 2/2020 Omata et al. ..... G03G 15/2039
10,564,578 B2 * 2/2020 Maeda et al. ..... G03G 15/2039
2011/0100972 A1 5/2011 Ikegami et al.

FOREIGN PATENT DOCUMENTS

JP 2018-022027 A 2/2018

* cited by examiner

*Primary Examiner* — William J Royer
(74) *Attorney, Agent, or Firm* — Venable LLP

(57) ABSTRACT

In a first operation mode in which a first addition value for each sheet of a recording material and a first initial control temperature, when the total sum of the first addition values exceeds a predetermined threshold value, a control portion of an image heating portion, which heats an image on the recording material, of an image forming apparatus changes the first initial control temperature to a first correction control temperature. When the operation mode is changed from the first operation mode to a second operation mode in which a second addition value different from the first addition value and a second initial control temperature different from the first initial control temperature, the control portion corrects the first correction control temperature based on a difference between initial control target temperatures.

5 Claims, 7 Drawing Sheets

IMAGE FORMING APPARATUS THAT CHANGES A CONTROL TARGET TEMPERATURE IN ACCORDANCE WITH A NUMBER OF SHEETS OF RECORDING MATERIAL THAT HAVE PASSED THROUGH AN IMAGE HEATING PORTION

BACKGROUND OF THE INVENTION

Field of the Invention

The present invention relates to an image forming apparatus such as an electrophotographic copier or a laser printer. In addition, the present invention relates to an image heating apparatus such as a fixing apparatus which is provided in an image forming apparatus and is used to heat an unfixed toner image formed on a recording material (paper or the like) to fix the unfixed toner image to the recording material, or a gloss imparting apparatus which improves the gloss value of the toner image by reheating the toner image fixed to the recording material.

Description of the Related Art

An electrophotographic image forming apparatus is provided with an image heating apparatus such as a fixing apparatus which heats and fixes a toner image to a recording material or a gloss imparting apparatus which improves the gloss value of the toner image by reheating the toner image fixed to the recording material. As these image heating apparatuses, heat roller-type and film heating-type image heating apparatuses are conventionally known. A film heating-type fixing apparatus (e.g., Japanese Patent Application Publication No. 2018-22027) includes a heater which has a heating resistor on a ceramic substrate, a fixing film which is heated while being in contact with the heater and rotates, and a pressure roller which forms a nip portion with the heater via the fixing film. A recording material bearing an unfixed toner image is heated while being held and transported by the nip portion, and the toner image on the recording material is thereby fixed to the recording material. The film heating-type fixing apparatus uses a film having low heat capacity as a fixing member, and hence the film heating-type fixing apparatus can reduce time required to cause the temperature of the fixing member to rise to a predetermined temperature. In addition, the rising time is short, and hence it is not necessary to warm the fixing member during standby, and it is possible to minimize power consumption.

It is known that the fixing performance of the film heating-type fixing apparatus changes when paper passage is repeated. As a technique for detecting the change of the fixing performance to obtain targeted fixability, there is proposed a technique for analyzing an increase in the temperature of a temperature detecting element when the power of a heater is turned on to predict the fixing performance, as disclosed in Japanese Patent Application Publication No. 2018-22027. However, the technique described above is easily influenced by a power supply environment and, in order to correct the influence, high cost is required in a power supply circuit. Accordingly, a more stable prediction system is desired.

SUMMARY OF THE INVENTION

In the case where temperature control is optimized for a low performance state to cope with the performance change of the fixing apparatus, the temperature control becomes redundant when the performance is improved, and a problem arises in that energy saving performance is lowered. Meanwhile, in the case where the temperature control is optimized for a high-performance state, faulty fixing occurs in the low performance state. In order to correct the performance change, it is effective to recognize the change of the fixing performance caused by the paper passage in advance. However, the speed of the change of the fixing performance differs depending on whether the temperature control is performed with a high temperature or a low temperature at the time of the paper passage. Accordingly, when the control is performed without considering the details of a paper passage record, there is a possibility that the change of the fixing performance is wrongly predicted, and the faulty fixing or a reduction in energy saving performance is caused. Note that the main cause of an influence exerted on the change speed of the fixing performance by the temperature control is change of the viscosity of grease interposed between a film inner surface and a heater surface.

The thickness of the grease is large at an initial stage of use of the fixing apparatus, and is gradually reduced by the paper passage. Thermal conductivity is lowered when the thickness of the grease is large and thermal conductivity is improved when the thickness of the grease is small, and hence the fixing performance is gradually improved by the paper passage. Meanwhile, by nature, the grease has viscosity which is lowered at a high temperature, and hence, when the temperature control of the fixing apparatus is performed with a high temperature, the thickness is reduced quickly. Examples of the cause of the performance change of the fixing apparatus additionally include a reduction in the thickness of the film and a reduction in the hardness of the pressure roller. With regard to the change by any of the above causes, the speed of the change tends to be high at a high temperature. In addition, the change of the fixing performance based on the thickness of the grease exerts an influence greater than those of the other changes, and the speed of the change thereof is higher than those of the other changes.

An object of the present invention is to provide an image forming apparatus including a fixing apparatus which does not cause faulty fixing while implementing optimum energy saving performance responding to fixing performance change.

In order to achieve the above object, an image forming apparatus in the present invention includes:

an image forming portion that forms an image on a recording material;

an image heating portion including a heater, the image heating portion using heat of the heater to heat the image;

a temperature detecting element that detects a temperature of the heater;

a control portion that controls power supplied to the heater based on the temperature detected by the temperature detecting element; and an acquisition portion that acquires the number of sheets of the recording material which has been passed through the image heating portion;

wherein the control portion has a plurality of operation modes which have different initial control temperatures each of which serves as a control target temperature for controlling the power and which is predetermined, and have different addition values each of which is used when the acquisition portion acquires the number of sheets and which is set for each sheet, wherein, among the plurality of operation modes, in a first operation mode in which the initial control temperature is a first initial control temperature and the addition value is a first addition value, the control target temperature is changed to a first correction control temperature obtained by correcting the first initial control temperature when the total sum of the first addition value exceeds a predetermined threshold value, wherein, when the operation mode is changed from the first operation mode to a second operation mode in which the initial control temperature is a second initial control temperature different from the first initial control temperature and the addition value is a second addition value different from the first addition value, the control target temperature is changed to a second correction control temperature obtained by correcting the first correction control temperature based on a difference between the first initial control temperature and the second initial control temperature.

In addition, in order to achieve the above object, an image forming apparatus in the present invention includes:

an image forming portion that forms an image on a recording material;

an image heating portion including a heater, the image heating portion using heat of the heater to heat the image;

a temperature detecting element that detects a temperature of the heater;

a control portion that controls power supplied to the heater based on the temperature detected by the temperature detecting element;

an acquisition portion that acquires the number of sheets of the recording material which has been passed through the image heating portion; and a cartridge including an accommodating portion that accommodates a toner for forming the image on the recording material, and a storage portion that stores information on the toner accommodated in the accommodating portion;

wherein the control portion has a plurality of operation modes which have different initial control temperatures each of which serves as a control target temperature for controlling the power and which is predetermined, and have different addition values each of which is used when the acquisition portion acquires the number of sheets and which is set for each sheet, wherein, among the plurality of operation modes, in a first operation mode in which the initial control temperature is a first initial control temperature and the addition value is a first addition value, the control target temperature is changed to a first correction control temperature obtained by correcting the first initial control temperature when the total sum of the first addition value exceeds a predetermined threshold value, wherein, when the cartridge is replaced during an operation in the first operation mode, the initial control temperature is changed from the first initial control temperature to a third initial control temperature stored in the storage portion of the cartridge after the replacement, the addition value is changed from the first addition value to a third addition value stored in the storage portion of the cartridge after the replacement, and the control target temperature is changed to a third correction control temperature obtained by correcting the first correction control temperature based on a difference between the first initial control temperature and the third initial control temperature.

Further, in order to achieve the above object, an image forming apparatus in the present invention includes:

an image forming portion that forms an image on a recording material;

an image heating portion including a heater, the image heating portion using heat of the heater to heat the image;

a temperature detecting element that detects a temperature of the heater;

a control portion that controls power supplied to the heater based on the temperature detected by the temperature detecting element;

an acquisition portion that acquires the number of sheets of the recording material which are passed through the image heating portion; and a cartridge including an accommodating portion that accommodates a toner for forming the image on the recording material, and a storage portion that stores information on the toner accommodated in the accommodating portion;

wherein the control portion has a plurality of operation modes which have different initial control temperatures each of which serves as a control target temperature for controlling the power and which is predetermined, and have different addition values each of which is used when the acquisition portion acquires the number of sheets and which is set for each sheet, wherein, among the plurality of operation modes, in a first operation mode in which the initial control temperature is a first initial control temperature and the addition value is a first addition value, the control target temperature is changed to a first correction control temperature obtained by correcting the first initial control temperature when the total sum of the first addition value exceeds a predetermined threshold value, wherein, when the operation mode is changed from the first operation mode to a second operation mode in which the initial control temperature is a second initial control temperature different from the first initial control temperature and the addition value is a second addition value different from the first addition value, and the cartridge is replaced, the control target temperature is changed to a second correction control temperature obtained by correcting the first correction control temperature based on a difference between the first initial control temperature and the second initial control temperature, the second correction control temperature is changed to a fourth correction control temperature by further correcting the second correction control temperature based on a difference between the second initial control temperature and a third initial control temperature stored in the storage portion of the cartridge after the replacement, and the addition value is changed from the second addition value to a third addition value stored in the storage portion of the cartridge after the replacement.

It is possible to prevent the occurrence of the faulty fixing while implementing the optimum energy saving performance responding to the fixing performance change of the fixing apparatus.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Description of Image Forming Apparatus

Hereinbelow, Embodiment 1 of the present invention will be described.

Figure 1:
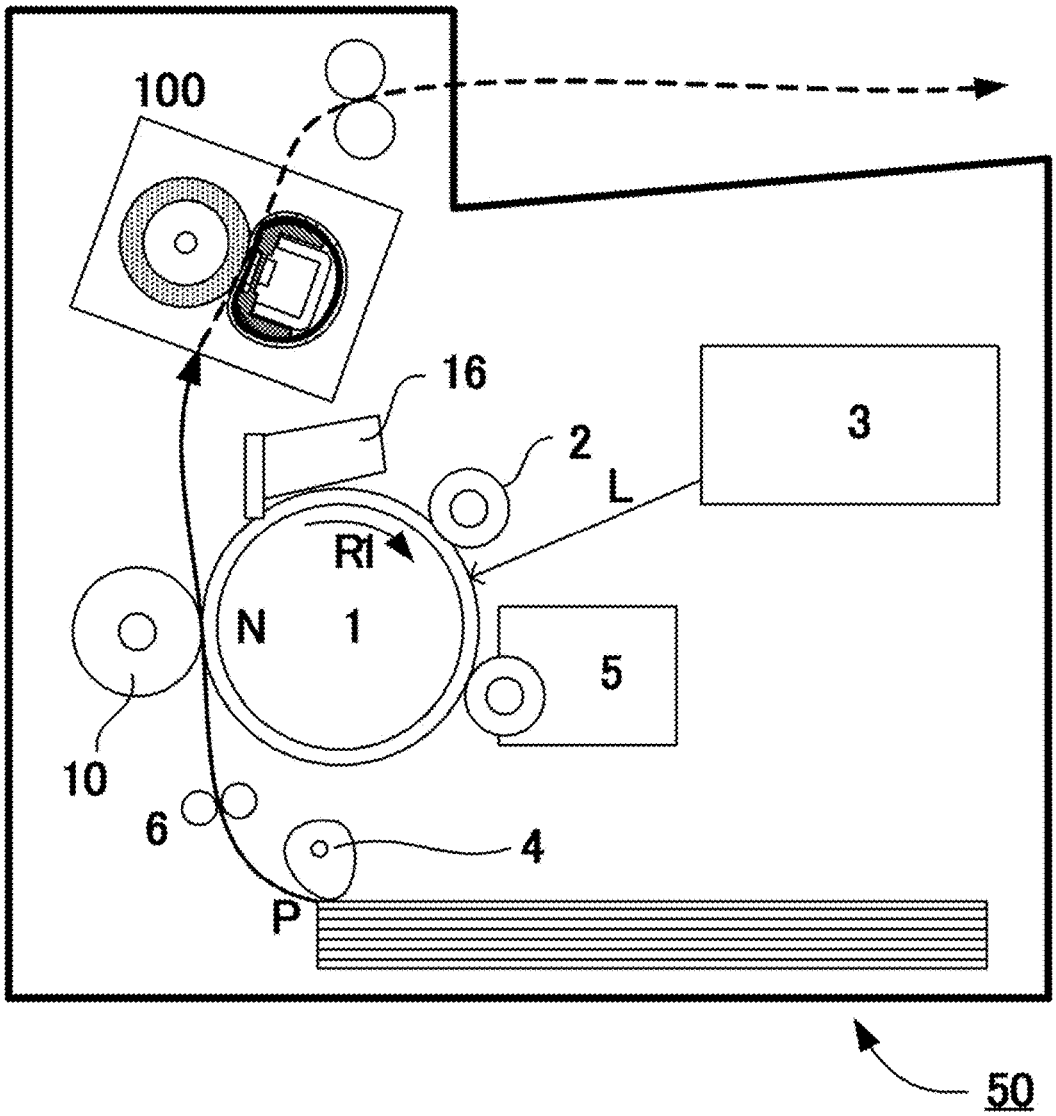
FIG. 1 is a schematic cross-sectional view of an image forming apparatus of Embodiment 1.

In the present embodiment, examples of a method for forming an unfixed toner image on a recording material and an image forming apparatus will be described by using a schematic view shown in FIG. 1. An image forming apparatus 50 in the present embodiment is an electrophotographic image forming apparatus which transfers a toner image on a photosensitive 1 drum directly onto a recording material P. On the peripheral surface of the photosensitive drum 1 serving as an image bearing member, a charging device 2, an exposure apparatus 3 which applies laser light L to the photosensitive drum 1, a developing device 5, a transfer roller 10, and a photosensitive drum cleaner 16 are disposed along a rotation direction (a direction of an arrow R1) in this order.

First, the surface of the photosensitive drum 1 is charged to a negative polarity by the charging device 2. Next, an electrostatic latent image is formed on the surface of the charged photosensitive drum 1 by the laser light L of the exposure apparatus 3 (the surface potential of an exposed portion is increased). Toner in the present embodiment is charged to the negative polarity, the negative toner is adhered only to an electrostatic latent image portion on the photosensitive drum 1 with the developing device 5 which contains black toner, and a toner image is thereby formed on the photosensitive drum 1. When the recording material P is fed by a sheet feeding roller 4, the recording material P is transported to a transfer nip portion N by a transport roller 6. A transfer bias having a positive polarity opposite to the polarity of the toner is applied to the transfer roller 10 from a power supply which is not shown, and the toner image on the photosensitive drum 1 is transferred onto the recording material P at the transfer nip portion N. Thus, the photosensitive drum 1, the charging device 2, the exposure apparatus 3, the developing device 5, and the transfer roller 10 constitute an image forming portion which forms an unfixed toner image on the recording material P. Untransferred toner on the surface of the photosensitive drum 1 after the transfer is removed by the photosensitive drum cleaner 16 having an elastic blade. The recording material P bearing the toner image is transported to a fixing apparatus 100 serving as a fixing portion (image heating portion), and heating and fixing of the toner image on the surface are performed in a state in which temperature is controlled to a proper temperature by a control portion.

Outline of Fixing Apparatus

Figure 2:
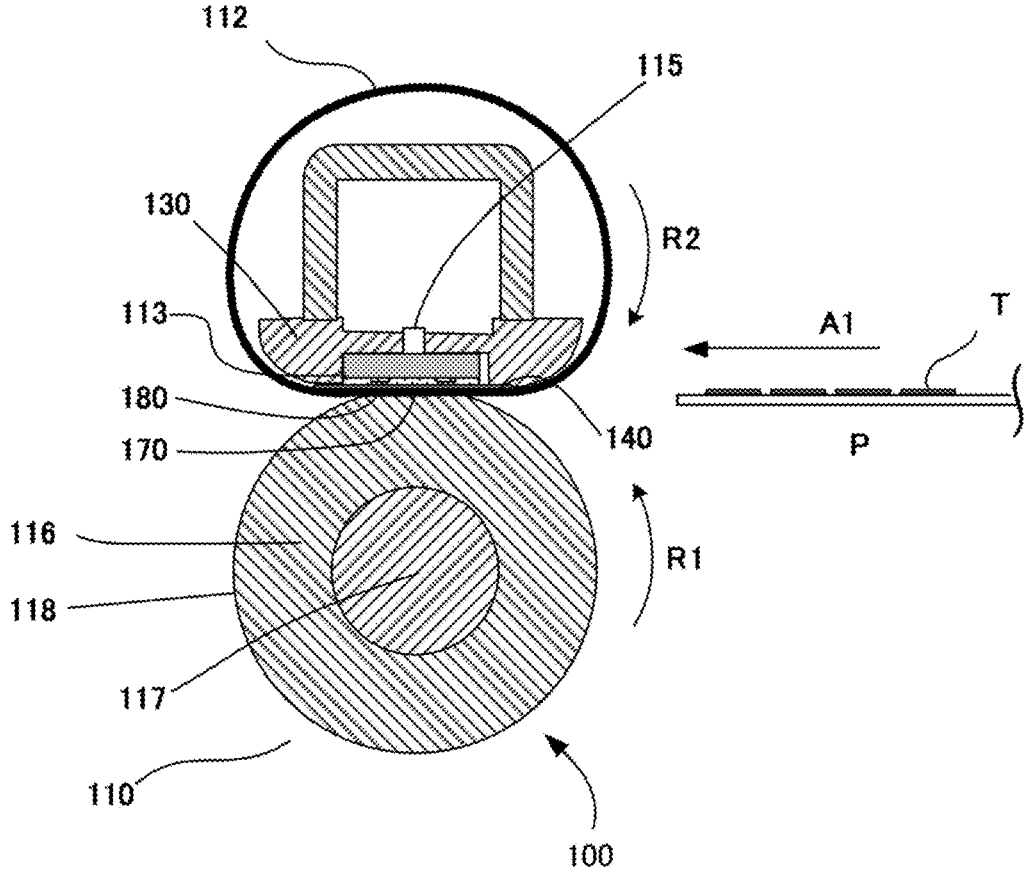
FIG. 2 is a schematic cross-sectional view of a fixing apparatus of Embodiment 1.

Next, hereinbelow, a description will be given of the fixing apparatus 100 serving as the fixing portion (image heating portion) in the image forming apparatus of the present embodiment. The fixing apparatus 100 of the present embodiment is a film heating-type fixing apparatus aimed at reducing rising time and reducing power consumption, as described above. FIG. 2 is a cross-sectional view of the fixing apparatus 100 in the present embodiment.

A heater 113 is held by a heater holder 130, and a fixing film 112 which is an endless belt is provided around the heater holder 130. The heater 113 slides on the inner surface of the fixing film 112 to heat the fixing film 112 from the inside. A sliding grease layer 140 is provided at an interface between the heater 113 and the fixing film 112, and the sliding grease layer 140 reduces friction between the heater 113 and the fixing film 112 to help the heater 113 and the fixing film 112 to slide. A pressure roller 110 serving as a pressure member presses the heater 113 from the outside of the fixing film 112 to press the recording material P against the heater 113 via the fixing film 112. An area in which the pressure roller 110 and the fixing film 112 are brought into contact with each other by pressing is used as a pressure nip. When the pressure roller 110 is driven in a direction of an arrow R1 in the drawing, the fixing film 112 receives power from the pressure roller 110 at the pressure nip, and is rotated in a direction of an arrow R2. When the recording material P to which an unfixed toner image T is transferred is transported to the pressure nip from a direction of an arrow A1 in the drawing, the unfixed toner image T is fixed to the recording material P.

Fixing Film

The fixing film 112 of the present embodiment has an outer diameter of 18 mm in its cylindrical state in which the fixing film 112 is not deformed, and has a multilayer structure in a thickness direction. The layer structure of the fixing film 112 includes a base layer for maintaining the strength of the film, and a release layer for reducing stains adhered to the surface.

The material of the base layer needs heat resistance because the base layer receives the heat of the heater 113 and also needs strength because the base layer slides on the heater 113, and hence it is preferable to use metal such as stainless steel or nickel, and a heat-resistant resin such as polyimide as the material thereof. In the present embodiment, a polyimide resin is used as the material of the base layer of the fixing film 112, and a carbon-based filler is added thereto to improve thermal conductivity and strength. As the thickness of the base layer becomes smaller, it becomes easier to transmit the heat of the heater 113 to the surface of the pressure roller 110. However, in order to prevent a reduction in strength, the thickness thereof is preferably about 15 μm to 100 μm, and the thickness thereof is set to 50 μm in the present embodiment.

As the material of the release layer of the fixing film 112, it is preferable to use fluorocarbon resins such as a perfluoroalkoxy resin (PFA), a polytetrafluoroethylene resin (PTFE), and a tetrafluoroethylene-hexafluoropropylene resin (FEP). In the present embodiment, among the fluorocarbon resins, the PFA excellent in releasability and heat resistance is used. The release layer may be a layer which is coated with a tube, and may also be a layer of which the surface is coated with paint. In the present embodiment, the release layer is molded by using a coat excellent in thin molding. With regard to the release layer, as the thickness of the layer becomes smaller, it becomes easier to transmit the heat of the heater 113 to the surface of the fixing film 112. However, when the thickness thereof is extremely small, durability is reduced, and hence the thickness thereof is preferably about 5 μm to 30 rpm, and is set to 10 μm in the present embodiment. In addition, an elastic layer may be provided between the base layer and the release layer though the elastic layer is not used in the present embodiment. In this case, as the material of the elastic layer, silicone rubber or fluorocarbon rubber is used.

Pressure Roller

The pressure roller 110 of the present embodiment has an outer diameter of 20 mm, and an iron core metal 117 having a diameter of 12 mm and an elastic layer 116 having a thickness of 4 mm are formed. As the material of the elastic layer 116, solid rubber or foamed rubber is used. The foamed rubber has low heat capacity and low thermal conductivity and heat on the surface of the pressure roller 110 is less likely to be absorbed in the internal portion of the foamed rubber, and hence the foamed rubber has an advantage that surface temperature easily increases and rising time can be reduced. In the present embodiment, foamed rubber obtained by foaming silicone rubber is used.

As the outer diameter of the pressure roller 110 becomes smaller, the heat capacity can become lower. However, when the outer diameter thereof is extremely small, the width of the pressure nip is reduced, and hence an appropriate outer diameter is required. In the present embodiment, the outer diameter is set to 20 mm. With regard to the thickness of the elastic layer 116, when the thickness thereof is extremely small, heat escapes to the core metal, and hence an appropriate thickness is required. In the present embodiment, the thickness of the elastic layer 116 is set to 4 mm. On the elastic layer 116, a release layer 118 made of the perfluoroalkoxy resin (PFA) is formed as the release layer of toner. Similarly to the release layer of the fixing film 112, the release layer 118 may also be a layer which is coated with a tube or a layer of which the surface is coated with paint and, in the present embodiment, a tube excellent in durability is used. As the material of the release layer 118, in addition to the PFA, a fluorocarbon resin such as PTFE or FEP, and fluorocarbon rubber or silicone rubber excellent in releasability may also be used.

With regard to the surface hardness of the pressure roller 110, as the surface hardness becomes lower, the width of the pressure nip obtained with low pressure becomes larger. In the present embodiment, the pressure roller having an Asker-C hardness of 50° (load of 4.9 N) is used. The pressure roller 110 is pressed against the heater 113 by a pressure portion which is not shown. With regard to applied pressure, the applied pressure is set to a total pressure of 150 N. The pressure roller 110 is caused to rotate at a surface moving speed of 200 mm/sec in the direction of the arrow R1 in the drawing by a rotation portion which is not shown.

Heater

The heater 113 of the present embodiment is a typical heater used in the film heating-type fixing apparatus, and the heater in which a heating resistor is provided on a ceramic substrate is used. As the heater 113, a heater obtained by applying, by screen printing, a heating resistor 180 made of Ag/Pd (silver palladium) to the surface of a substrate made of alumina having a width of 7 mm in a recording material transport direction and a thickness of 1 mm until a thickness of 10 μm is reached, and covering the heating resistor 180 with glass 170 having a thickness of 50 μm which serves as a heating element protective layer is used. A temperature detecting element 115 is in contact with the ceramic substrate. By properly controlling current flown to the heating resistor 180 and power supplied to the heater 113 based on the result of detection by the temperature detecting element 115, i.e., a signal related to detected temperature, the temperature of the heater 113 is adjusted. An unfixed toner image T formed on the recording material P is heated by using the heat of the heater 113. Note that the temperature detecting element 115 only needs to properly detect the temperature of the heater 113 or the fixing film 112 and, for example, the temperature detecting element 115 may directly detect the temperature of the fixing film 112.

Control Mode

A target temperature (control target temperature) of the present embodiment will be described by using Table 1. The fixing apparatus serving as the fixing portion (image heating portion) in the present embodiment can operate in a plurality of operation modes. The fixing apparatus has a function in which a user sets a basis weight of the recording material P, whereby a fixing mode serving as the operation mode of the fixing apparatus (hereinafter simply referred to as a fixing mode) is changed, and a correction for optimizing the target temperature is added. Paper having a basis weight of 75 $g/m^2$ to 85 $g/m^2$ is used as ordinary paper, and the target temperature at an initial stage of use of the fixing apparatus in the present fixing mode (initial control temperature) is set to 220° C. Paper having a basis weight of 61 $g/m^2$ to 74 $g/m^2$ is used as thin paper 1, the fixing mode is changed, the target temperature is corrected by Δ−10° C., and the target temperature at the initial stage of use of the fixing apparatus (initial control temperature) is set to 210° C. Paper having a basis weight of 50 $g/m^2$ to 60 $g/m^2$ is used as thin paper 2, the fixing mode is changed, the target temperature is corrected by Δ−20° C., and the target temperature at the initial stage of use of the fixing apparatus (initial control temperature) is set to 200° C.

Next, the present embodiment includes a counter which corresponds to acquisition portion for acquiring the number of sheets of the recording material and is used to manage fixing performance of the fixing apparatus during passages of the recording material. A correction operation which uses the above counter will be described also by using Table 1. The counter in an initial state of the fixing apparatus is set at 0, and 100 is added as a first addition value every time one sheet is passed in the case of the ordinary paper. Predetermined threshold values are set in the counter, and a threshold value 1, a threshold value 2, and a threshold value 3 are 20000, 45000, and 90000, respectively. When the total sum of the addition values exceeds the threshold value, a first correction in which the target temperature is corrected by Δ−5° C., Δ−10° C., or Δ−15° C. is performed. Next, as an example, the operation mode in the case of the ordinary paper is referred to as a first operation mode, and the operation mode in the recording material different from the ordinary paper such as the thin paper 1 or the thin paper 2 is referred to as a second operation mode. When continuous heating in which an image on the recording material is continuously heated by the above-described fixing apparatus (image heating portion) is performed, in the case where the fixing mode is changed from the first operation mode to the second operation mode, the addition value of the counter is changed from the first addition value to a second addition value different from the first addition value. As a result, a relationship between the threshold value for the correction to fixing performance change and the number of passed sheets is corrected. Subsequently, a second correction is performed on the target temperature having been subjected to the first correction (first correction control temperature) based on a difference between a first initial control temperature and a second initial control temperature which are the target temperatures at the initial stage of use of the fixing apparatus set in the individual operation modes. As the result of the second correction, the target temperature is changed to a temperature suitable for the recording material (second correction control temperature), and it becomes possible to appropriately maintain the fixing performance and energy saving performance. Note that the second addition value mentioned above is set to 75 in the case of the thin paper 1, and is set to 50 in the case of the thin paper 2.

of the sliding grease layer 140 and, as the temperature decreases, the viscosity of the sliding grease layer 140 increases, and time required to change the thickness thereof increases.

In addition, when the initial target temperature is constant, as the transport speed decreases, it is necessary to increase the addition value of the counter to increase the speed of the change, and reduce the number of passed sheets corresponding to the threshold value. This is because, as the transport speed becomes lower, time required for the passage of one sheet becomes longer, and hence the amount of change of the sliding grease layer 140 per sheet becomes larger, and the apparent speed of the change of the fixing performance becomes higher even when the number of passed sheets is constant.

Control Mode in Comparative Example

The configuration of each comparative example of the present embodiment will be described also by using Table 1.

TABLE 1

Correction Control in Embodiment 1

| | Embodiment | | | Comparative Example 1 | | | Comparative Example 2 | | |
|---|---|---|---|---|---|---|---|---|---|
| Paper passage mode | Ordinary paper | Thin paper 1 | Thin paper 2 | Ordinary paper | Thin paper 1 | Thin paper 2 | Ordinary paper | Thin paper 1 | Thin paper 2 |
| Counter addition value | 100 | 75 | 50 | | 1 | | | Not available | |
| Initial target temperature | 220° C. | 210° C.<br>Δ − 10° C. | 200° C.<br>Δ − 20° C. | 220° C. | 210° C.<br>Δ − 10° C. | 200° C.<br>Δ − 20° C. | 220° C. | 210° C.<br>Δ − 10° C. | 200° C.<br>Δ − 20° C. |
| Threshold value 1 | Threshold 1 = 20000 | | | Threshold 1 = 200 | | | Not available | | |
| | 215° C.<br>Δ − 5° C. | 205° C.<br>Δ − 5° C. | 195° C.<br>Δ − 5° C. | 215° C.<br>Δ − 5° C. | 206° C.<br>Δ − 4° C. | 197° C.<br>Δ − 3° C. | | | |
| Threshold value 2 | Threshold 2 = 45000 | | | Threshold 2 = 450 | | | | | |
| | 210° C.<br>Δ − 10° C. | 200° C.<br>Δ − 10° C. | 190° C.<br>Δ − 10° C. | 210° C.<br>Δ − 10° C. | 202° C.<br>Δ − 8° C. | 194° C.<br>Δ − 6° C. | | | |
| Threshold value 3 | Threshold 3 = 90000 | | | Threshold 3 = 900 | | | | | |
| | 205° C.<br>Δ − 15° C. | 195° C.<br>Δ − 15° C. | 185° C.<br>Δ − 15° C. | 195° C.<br>Δ − 15° C. | 198° C.<br>Δ − 12° C. | 190° C.<br>Δ − 10° C. | | | |
| Threshold value 4 | Not necessary | | | Threshold 4 = 1200 | | | | | |
| | | | | 195° C.<br>Δ − 15° C. | 195° C.<br>Δ − 15° C. | 188° C.<br>Δ − 12° C. | | | |
| Threshold value 5 | | | | Threshold 5 = 1800 | | | | | |
| | | | | 195° C.<br>Δ − 15° C. | 195° C.<br>Δ − 15° C. | 185° C.<br>Δ − 15° C. | | | |

Note that, although the present embodiment has been described by using the operation modes related to the ordinary paper and two kinds of the thin papers, a plurality of fixing modes (operation modes) which can be set by the user such as a thick paper mode, a small-sized paper mode, a transport speed change mode, and a fixability improvement mode may be prepared. In this case, the addition value of each sheet of the recording material in the counter and the target temperature at the initial stage of use of the fixing apparatus (initial control temperature) are determined for each mode in advance, and the change amount (correction amount) of the target temperature every time the total sum of the addition values exceeds the above threshold value is set in advance. With this, it is possible to set optimum parameters for following the change of the fixing performance in each mode.

Note that, in general, in the setting of the above parameters, as the initial target temperature in the fixing mode decreases, it is necessary to reduce the addition value of the counter to reduce the speed of the change, and increase the number of passed sheets corresponding to the threshold value.

This is because, as described above, the change of the fixing performance is caused by the change of the thickness In Comparative Example 1, the correction (first correction) of the target temperature at the initial stage of use of the fixing apparatus to each of the fixing modes (operation modes) of the ordinary paper, the thin paper 1, and the thin paper 2 is the same as that in the present embodiment. In addition, the counter which corresponds to the acquisition portion for acquiring the number of sheets of the recording material and is used to manage the number of passed sheets of the fixing apparatus is also provided in Comparative Example 1, and 1 is added as the addition value for each sheet. A threshold value 1, a threshold value 2, a threshold value 3, a threshold value 4, and a threshold value 5, each of which corresponds to the total sum of the addition values added according to the number of sheets of the recording material, are set to 200, 450, 900, 1200, and 1800, respectively. In the case where the total sum of the addition values exceeds the threshold values, the target temperature is corrected by Δ−5° C., Δ−10° C., Δ−15° C., Δ−15° C., and Δ−15° C. in the case of the ordinary paper. In addition, the target temperature is corrected by Δ−4° C., Δ−8° C., Δ−12° C., Δ−15° C., and Δ−15° C. in the case of the thin paper 1, and the target temperature is corrected by Δ−3° C., Δ−6° C., Δ−10° C., Δ−10° C., and Δ−15° C. in the case of the thin paper 2.

In Comparative Example 1, in order to cope with the change of the speed of the fixability change caused by the change of the fixing mode, it is necessary to prepare many threshold values. In the present embodiment, as compared with Comparative Example 1, the number of kinds of the threshold values which are set for the total sums of the addition values is reduced, and the addition values are set according to the type of the recording material, and hence the present embodiment has an advantage that it is possible to correct only a part which requires the correction with fewer parameters. This tendency become more conspicuous when the number of the user-settable modes described above is increased or the change of the speed of the fixability change caused by the change of the mode is significant. In addition, in Comparative Example 1, even when the used fixing mode is changed during the operation, the number of the addition values of the counter set for the recording material is only one, and hence it is not possible to correct the relationship between the preset threshold value and the number of passed sheets. In addition, as Comparative Example 2, an example in which the counter for managing the number of passed sheets is not provided, and the adjustment of the target temperature based on the paper passage is not performed is prepared.

Evaluation Result

The result of evaluation performed by using the present embodiment and the comparative examples will be described.

In the present evaluation, evaluation was performed on three types of conditions which included the case where only the ordinary paper was passed from the initial stage of use of the fixing apparatus, the case where only the thin paper 2 was passed, and the case where the thin paper was passed at the initial stage thereof and the paper to be passed was then switched to the ordinary paper during the operation. The result of evaluation of the fixing performance and the energy saving performance under each condition was summarized in Table 2. While the present embodiment satisfied the fixing performance and the energy saving performance in all of the cases, Comparative Example 1 did not satisfy the fixing performance in the case where the thin paper was passed at the initial stage thereof and the paper to be passed was then switched to the ordinary paper during the operation. Comparative Example 2 did not satisfy the energy saving performance in all of the cases. In addition, when the thin paper 1 was used instead of the thin paper 2, the result indicated evaluation at a level between that of the thin paper 2 and that of the ordinary paper. Hereinafter, the details of the result under each condition will be described.

Figure 3:
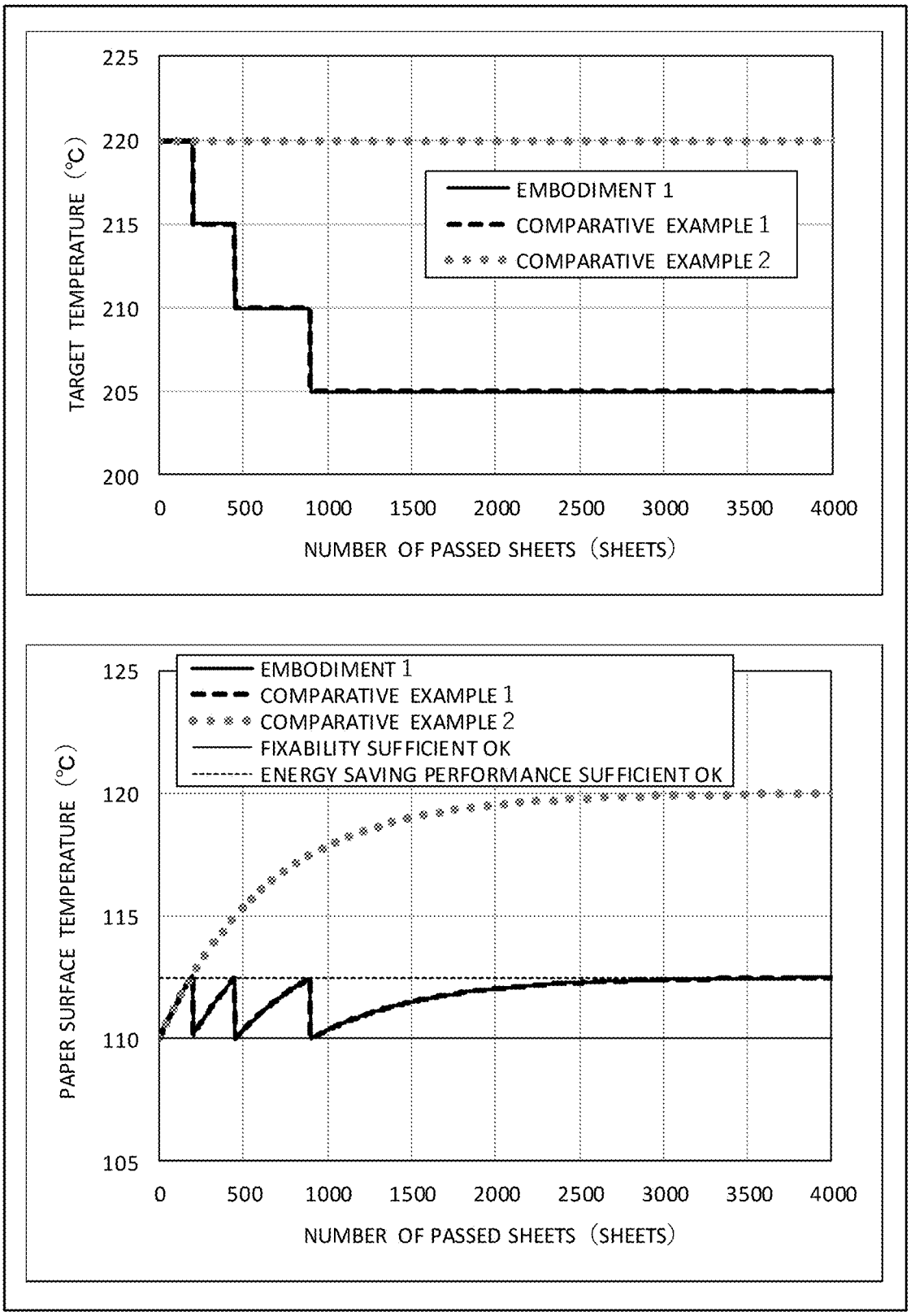
FIG. 3 shows changes of a target temperature and a paper surface temperature in the case where ordinary paper is used.

First, the result of the case where only the ordinary paper was passed will be described by using FIG. 3. In this case, the changes of the target temperatures (control target temperatures) of the present embodiment and Comparative Example 1 are identical to each other. That is, the initial target temperature is 220° C., and the target temperature is 215° C. when the number of passed sheets of the recording material reaches 201, 210° C. when the number of passed sheets thereof reaches 451, and 205° C. when the number of passed sheets thereof reaches 901. Meanwhile, the target temperature of Comparative Example 2 is 220° C. and is constant. As an index of evaluation of the fixing performance, a paper surface temperature immediately after a fixing nip is shown in FIG. 3 (hereinafter, the paper surface temperature immediately after the fixing nip is simply referred to as a paper surface temperature). In the current evaluation, faulty fixing does not occur when the paper surface temperature is not less than 110° C. In each of the present embodiment and Comparative Example 1, as shown in FIG. 3, the paper surface temperature is controlled in a range of 110° C. to 112.5° C., the occurrence of the faulty fixing is prevented, and redundant power consumption is reduced.

Meanwhile, in Comparative Example 2, although the initial paper surface temperature is 110° C., the paper surface temperature rises as the number of passed sheets increases. At the time when the number of passed sheets becomes about 2000 or later, the paper surface temperature is higher than a temperature at which the fixability becomes sufficient by about Δ10° C., and is higher by about Δ20° C. in terms of the target temperature. In terms of power consumption at the time of continuous print of 50 pages, this corresponds to redundant power of about 12%. Note that, in the present embodiment, a target is to reduce redundant power to 3% or less in an optimum setting which satisfies the fixability. This corresponds to Δ2.5° C. in terms of the control range of the paper surface temperature described above, and corresponds to Δ5° C. in terms of the target temperature.

Figure 4:
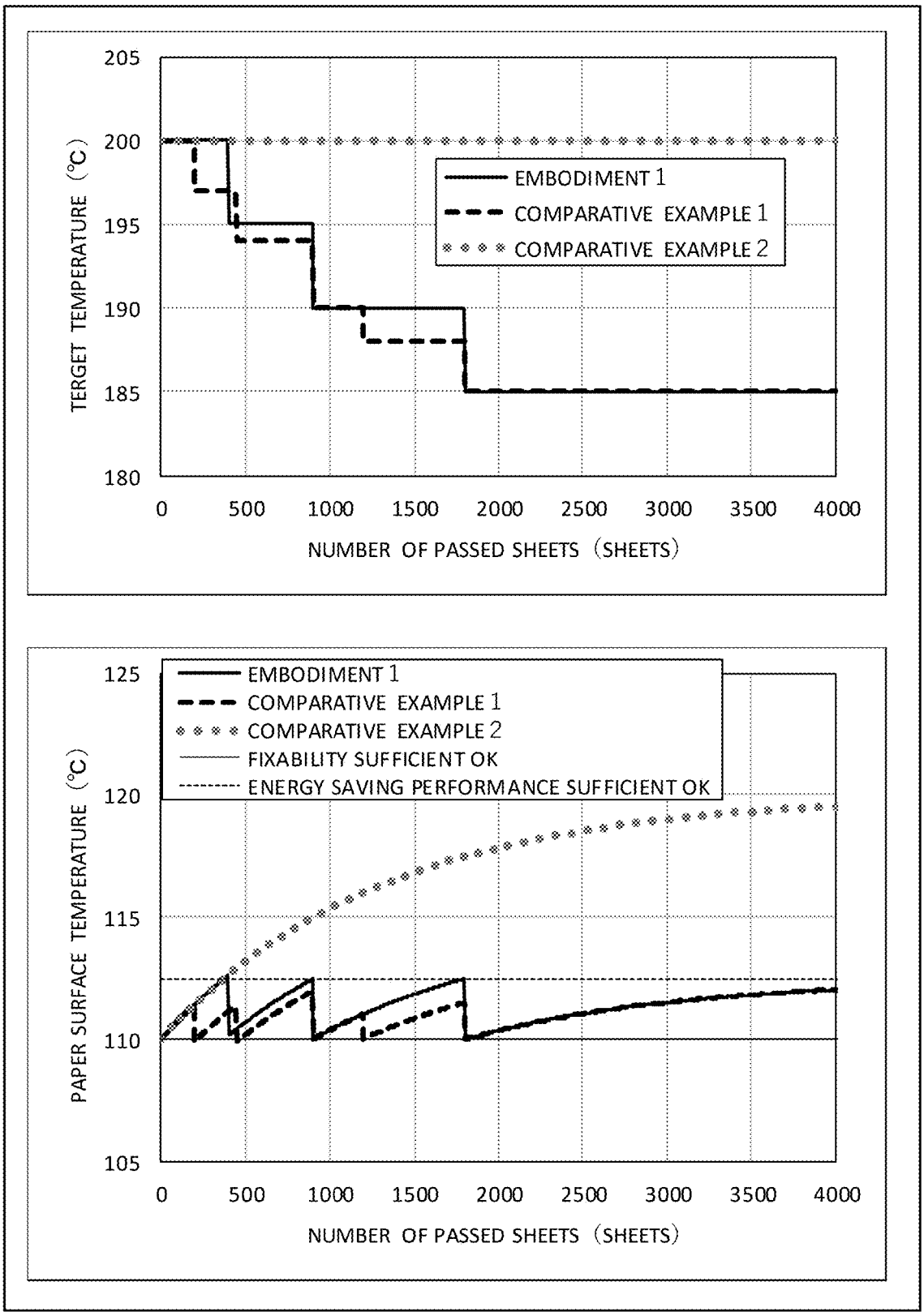
FIG. 4 shows the changes of the target temperature and the paper surface temperature in the case where thin paper is used.

Next, the result of the case where only the thin paper 2 was passed will be described by using FIG. 4. First, in Comparative Example 2, the target temperature is 200° C. and is constant. In this case, as compared with FIG. 3 of the case where only the ordinary paper was passed, the change of the paper surface temperature is gentle. This is because the target temperature is lower than 220° C. in the case of the ordinary paper, and hence the viscosity of the sliding grease layer 140 is high, and it takes time for the sliding grease layer 140 to become thin to increase the fixing performance.

TABLE 2

Fixability and Energy Saving Performance in each of Embodiment, Comparative Example 1, and Comparative Example 2 under each Condition

| | Embodiment | Comparative Example 1 | Comparative Example 2 |
|---|---|---|---|
| Only Ordinary paper was passed | Fixing performance is good<br>Energy saving performance is good | Fixing performance is good<br>Energy saving performance is good | Fixing performance is good<br>Energy saving performance is bad |
| Only thin paper 2 was passed | Fixing performance is good<br>Energy saving performance is good | Fixing performance is good<br>Energy saving performance is good | Fixing performance is good<br>Energy saving performance is bad |
| Thin paper 2 was passed only initially and ordinary papar was then passed | Fixing performance is good<br>Energy saving performance is good | Fixing performance is bad<br>Energy saving performance is good | Fixing performance is good<br>Energy saving performance is bad |

Note that, also in the thin paper 2, the paper surface temperature for preventing the occurrence of the faulty fixing is not less than 110° C. In Comparative Example 2, although the faulty fixing does not occur, at the time when the number of passed sheets becomes about 3500 or later, power corresponding to about Δ10° C. in terms of the paper surface temperature, or corresponding to about Δ20° C. in terms of the target temperature is redundantly consumed. Next, the initial target temperature of the present embodiment is 200° C., and the target temperature thereof is 195° C. at the time when the number of passed sheets of the recording material becomes 401 or later, 190° C. at the time when the number of passed sheets thereof becomes 901 or later, and 185° C. at the time when the number of passed sheets thereof becomes 1801 or later. Timing of the change of the threshold value is corrected so as to cope with a slowdown in the increase of the fixing performance, and hence the paper surface temperature is appropriately controlled in a range of 110° C. to 112.5° C. Lastly, in Comparative Example 1, the initial target temperature is 200° C., and the target temperature is 197° C. at the time when the number of passed sheets of the recording material becomes 201 or later, 194° C. at the time when the number of passed sheets thereof becomes 451 or later, 190° C. at the time when the number of passed sheets thereof become 901 or later, 188° C. at the time when the number of passed sheets thereof becomes 1201 or later, and 185° C. at the time when the number of passed sheets thereof becomes 1801 or later. Also in Comparative Example 1, the paper surface temperature is appropriately controlled in a range of 110° C. to 112.5° C.

Figure 5:
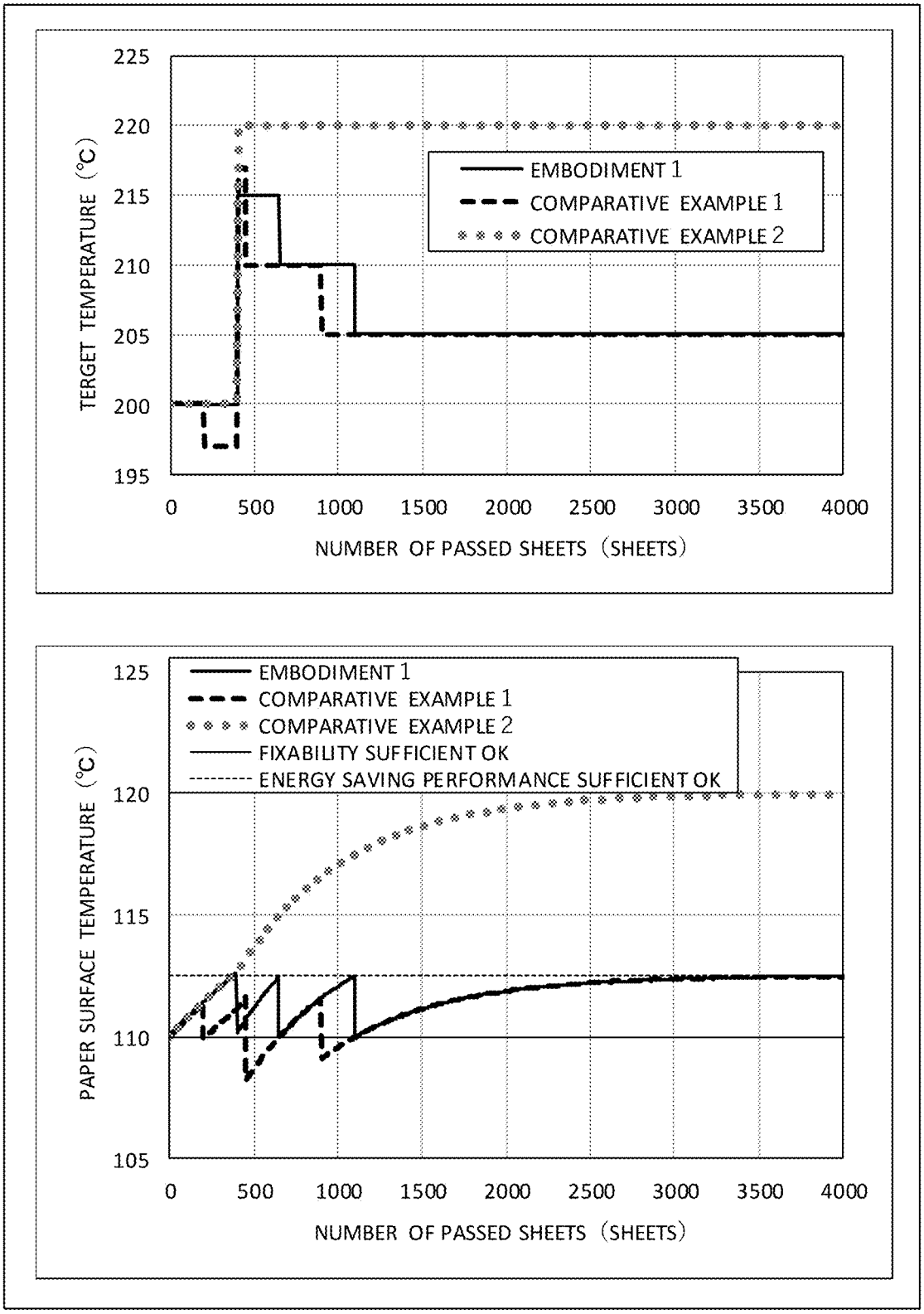
FIG. 5 shows the changes of the target temperature and the paper surface temperature in the case where the thin paper and the ordinary paper are used in this order.

Lastly, the case where the thin paper 2 was passed until the number of passed sheets reached 400, and the ordinary paper was then passed will be described by using FIG. 5. First, in Comparative Example 2, the target temperature is 200° C. and is constant until the number of passed sheets reaches 400, and is 220° C. at the time when the number of passed sheets become 401 or later. The change of the paper surface temperature is gentle similarly to the example in FIG. 4 until the number of passed sheets reaches 400 and, at the time when the number of passed sheets becomes 400 or later, the target temperature rises, and hence, similarly to the example in FIG. 3, the change of the paper surface temperature is steep. The paper surface temperature for preventing the occurrence of the faulty fixing is not less than 110° C., and hence power consumption is redundant similarly to the previous example shown in each of FIGS. 3 and 4.

Next, the present embodiment will be described. In the present embodiment, the change similar to that of the example in FIG. 4 is displayed until the number of passed sheets reaches 400, and the target temperature is 200° C. When the thin paper 2 is still used at the time when the number of passed sheets becomes 401 or later, the total sum of the addition values exceeds 20000 serving as the threshold value 1, and hence the target temperature is corrected to 195° C., as shown in Table 1. However, at the time when the number of passed sheets becomes 401 or later, i.e., when the total sum of the addition values exceeds 20000 serving as the threshold value 1, the recording material is switched from the thin paper 2 to the ordinary paper. Consequently, the target temperature is not changed to the target temperature used when the threshold value 1 in the case of the thin paper 2 is exceeded, i.e., 195° C. which is the target temperature after the above-described first correction is performed (first correction control temperature). In this case, instead of 195° C. serving as the first correction control temperature in the case of the thin paper 2, the target temperature is changed to 215° C. which is a temperature corrected based on a difference between the initial target temperatures in the case of the ordinary paper and in the case of the thin paper 2 (the first initial control temperature and the second initial control temperature). Note that 215° C. is also a temperature when the initial target temperature (initial control temperature) of 220° C. is corrected by Δ−5° C. when the threshold value 1 in the case of the ordinary paper is exceeded. 215° C. corresponds to the second correction control temperature described above. Based on the foregoing, the target temperature is changed from 200° C. to 215° C. Thereafter, the correction responding to the increase of the fixing performance of the fixing apparatus is applied, and hence the paper surface temperature is appropriately controlled in a range of 110° C. to 112.5° C.

In Comparative Example 1, the proper paper surface temperature is maintained until the number of passed sheets reaches 400. However, the addition value to the counter for temperature correction is not changed, and hence, when the total sum of the addition values exceeds the threshold value of the counter when the number of passed sheets reaches 451, the target temperature is corrected to 210° C. which is the target temperature in the case where the threshold value 2 of the ordinary paper is exceeded. As a result, the paper surface temperature becomes lower than 110° C., and the faulty fixing occurs. This is because, irrespective of the fact that the thin paper is passed until the number of passed sheets reaches 450 and the increase of the fixing performance is gentle, the threshold value in the case where only the ordinary paper is passed is used when the paper to be passed is switched to the ordinary paper.

As described thus far, in the case where the target temperature which differs depending on the fixing mode is used, while the correction of the target temperature is performed according to the number of passed sheets of the recording material in the fixing apparatus, the addition value corresponding to the number of passed sheets which is used to perform the above correction is changed. With this, it is possible to reflect the change of the performance of the fixing apparatus to appropriately maintain the fixing performance and the energy saving performance. Note that the correction of the target temperature has been described by using, as the example, the case where continuous paper passage, i.e., continuous heating in which the image formed on the recording material is continuously heated is performed, but the correction of the target temperature is not limited thereto. For example, also in the case where the sheets of the recording material are passed one by one at regular intervals, the number of passed sheets of the recording material is counted with the counter by adding up the passed sheets and, when the total sum of the addition values exceeds a predetermined threshold value, the correction of the target temperature is performed in the same manner as in the case where the image on the recording material is continuously heated.

Embodiment 2

Hereinbelow, Embodiment 2 of the present invention will be described. The basic main body configuration and the structures of the fixing apparatus, the sheet feeding portion, and the transport portion are the same as those in Embodiment 1, and hence the description thereof will be omitted. In the present embodiment, the developing device 5 is attachable, detachable, and exchangeable as a cartridge. The cartridge is provided with an accommodating portion for accommodating toner described later, and the developing device 5 includes a storage portion for storing information on the toner in the accommodating portion which is not shown. For example, the target temperature of the fixing apparatus can be changed based on the information of the storage portion. Note that the cartridge which is an attachable and detachable portion may or may not include the charging device 2, the photosensitive drum 1, the transfer roller 10, and the photosensitive drum cleaner 16 as long as the cartridge includes the developing device 5 and the storage portion.

With regard to toner, the same toner as that in Embodiment 1 is used as toner 1. The target temperature of the toner 1, and the correction using the counter serving as the portion for acquiring the number of sheets of the recording material are the same as those in Embodiment 1. In the present embodiment, toner 2 different in fixing performance from the toner in Embodiment 1 is prepared. In such a case, similarly to Embodiment 1, the present embodiment has a target that, when power consumption which satisfies the fixability is 100%, the maximum power consumption is suppressed to 103% or less. Note that the toner 2 is the toner which is improved such that fixing is allowed at a temperature lower than that of the toner 1, and aims at allowing the user to obtain lower power consumption. However, in consideration of the inventory state of the user and a distribution state in a market, consideration is also given to the case where the toner 2 is used initially and the toner 1 is then used during the operation.

Control of the toner 2 which is used when the cartridge is replaced will be described by using Table 3. When the toner 2 is used, the correction of the target temperature corresponding to the fixability of the toner 2 is performed based on a difference between the initial target temperature (first initial control temperature) in the toner 1 and an initial target temperature (third initial control temperature) in the toner 2. As a result, the target temperature at the initial stage of use of the fixing apparatus is 190° C. When the type of the toner is changed from the toner 1 to the toner 2, the counter addition value is changed from the counter addition value (first addition value) in the case where the toner 1 which is identical to the toner in Embodiment 1 is used to the counter addition value (third addition value) which is 33. As a result, the relationship between the threshold value for the correction to the fixing performance change and the number of passed sheets is also corrected. Similarly to Embodiment 1, the correction values of the target temperature of threshold values 1 to 3 are Δ−5° C., Δ−10° C., and Δ−15° C.

TABLE 3

Correction Control in Embodiment 2

| | Embodiment | | Comparative Example 3 | | Comparative Example 4 | |
|---|---|---|---|---|---|---|
| Toner type | Toner 1 | Toner 2 | Toner 1 | Toner 2 | Toner 1 | Toner 2 |
| Counter addition value | 100 | 33 | 1 | | Not available | |
| Initial target temperature | 220° C. | 190° C.<br>Δ − 30° C. | 220° C. | 190° C.<br>Δ − 30° C. | 220° C. | 190° C.<br>Δ − 30° C. |
| Threshold value 1 | Threshold value 1 = 20000<br>215° C.<br>Δ − 5° C. | 185° C.<br>Δ − 5° C. | Threshold value 1 = 200<br>215° C.<br>Δ − 5° C. | 188° C.<br>Δ − 2° C. | Not available | |
| Threshold value 2 | Threshold value 2 = 45000<br>210° C.<br>Δ − 10° C. | 180° C.<br>Δ − 10° C. | Threshold value 2 = 450<br>210° C.<br>Δ − 10° C. | 186° C.<br>Δ − 4° C. | | |
| Threshold value 3 | Threshold value 3 = 90000<br>205° C.<br>Δ − 15° C. | 175° C.<br>Δ − 15° C. | Threshold value 3 = 900<br>205° C.<br>Δ − 15° C. | 183° C.<br>Δ − 7° C. | | |
| Threshold value 4 | Not necessary | | Threshold value 4 = 1800<br>205° C.<br>Δ − 15° C. | 178° C.<br>Δ − 12° C. | | |
| Threshold value 5 | | | Threshold value 5 = 2700<br>205° C.<br>Δ − 15° C. | 175° C.<br>Δ − 15° C. | | |

Note that the above setting is the setting in the ordinary paper, but the setting may also be adapted to a user-settable mode such as a paper type mode. In that case, for example, the initial target temperature when the toner 2 is used and the thin paper is used is lower than the target temperature in the case where the toner 2 is used. A reason for that is as follows. First, the type of the recording material is changed from the ordinary paper to the thin paper, and the correction of the target temperature (the second correction in Embodiment 1) when the fixing mode is changed from the first operation mode to the second operation mode is performed. Next, the correction based on a difference between the target temperature at the initial stage of use of the fixing apparatus in the case of the second operation mode and the target temperature at the initial stage of use of the fixing apparatus in the case of the toner 2 stored in the storage portion of the cartridge is further performed on the corrected target temperature (second correction control temperature). As a result, the target temperature is changed from the second correction control temperature to a fourth correction control temperature, and hence the target temperature is further reduced. In addition, with regard to the counter addition value, the addition value is changed when the type of the recording material is changed, and the changed addition value is subjected to the change of the addition value resulting from the change of the toner type, and hence the counter addition value is further reduced.

Control Mode in Comparative Example

The configuration of each comparative example of the present embodiment will be described by using Table 3. The target temperatures at the initial stage of use of the fixing apparatus of the toners 1 and 2 in Comparative Example 3 are the same as those in Embodiment 1. In addition, in Comparative Example 3, the counter for managing the number of passed sheets in the fixing apparatus is provided, and 1 is added for each sheet. A threshold value 1 of the total sum of the addition values is 200, a threshold value 2 thereof is 450, and a threshold value 3 thereof is 900. When the total sum of the addition values exceeds the threshold values, the target temperature is corrected by Δ−5° C., Δ−10° C., and Δ−15° C. in the case of the toner 1, and the target temperature is corrected by Δ−2° C., Δ−4° C., and Δ−7° C. in the case of the toner 2. In addition, as Comparative Example 4, an example in which the counter for managing the number of passed sheets is not provided and the adjustment of the target temperature based on the paper passage is not performed is prepared.

Evaluation Result

The result of evaluation performed by using the present embodiment and the comparative examples will be described.

In the present evaluation, evaluation was performed on three types of conditions which included the case where only the toner 1 was used from the initial stage of use of the fixing apparatus, the case where only the toner 2 was used, and the case where the toner 2 was used initially and the toner to be used was then switched to the toner 1 during the operation. The result of evaluation of the fixing performance and the energy saving performance under each condition was summarized in Table 4. While the present embodiment satisfied the fixing performance and the energy saving performance in all of the cases, Comparative Example 3 did not satisfy the fixing performance in the case where the toner 2 was used initially and the toner to be used was then switched to the toner 1 during the operation. Comparative Example 4 did not satisfy the energy saving performance in all of the cases. Hereinafter, the details of the result under each condition will be described.

faulty fixing is not less than 95° C. In Comparative Example 4, although the faulty fixing does not occur, power corresponding to about Δ10° C. in terms of the paper surface temperature, or corresponding to about Δ20° C. in terms of the target temperature is redundantly consumed at the time when the number of passed sheets becomes about 4000 or later.

Next, the initial target temperature of the present embodiment is 190° C., and the target temperature is 185° C. at the time when the number of passed sheets of the recording material becomes 607 or later, 180° C. at the time when the number of passed sheets thereof becomes 1364 or later, and 175° C. at the time when the number of passed sheets thereof becomes 2728 or later. Timing of the change of the threshold value is corrected so as to cope with the slowdown in the increase of the fixing performance, and hence the paper surface temperature is appropriately controlled in a range of 95° C. to 97.5° C. Lastly, in Comparative Example 3, the initial target temperature is 190° C., and the target temperature is 188° C. at the time when the number of passed sheets of the recording material becomes 201 or later, 186° C. at the time when the number of passed sheets thereof becomes 451 or later, 183° C. at the time when the number of passed sheets thereof becomes 901 or later, 178° C. at the time when the number of passed sheets thereof becomes 1801 or later, and 175° C. at the time when the number of passed sheets thereof becomes 2701 or later. Also in Comparative Example 3, the paper surface temperature is appropriately controlled in a range of 95° C. to 97.5° C.

TABLE 4

Fixability and Energy Saving Performance in each of Embodiment 2, Comparative Example 3, and Comparative Example 4 under each Condition

| | Embodiment 2 | Comparative Example 3 | Comparative Example 4 |
|---|---|---|---|
| Only toner 1 was used | Fixing performance is good<br>Energy saving performance is good | Fixing performance is good<br>Energy saving performance is good | Fixing performance is good<br>Energy saving performance is bad |
| Only toner 2 was used | Fixing performance is good<br>Energy saving performance is good | Fixing performance is good<br>Energy saving performance is good | Fixing performance is good<br>Energy saving performance is bad |
| Toner 2 was used only initially and toner 1 was then used | Fixing performance is good<br>Energy saving performance is good | Fixing performance is bad<br>Energy saving performance is good | Fixing performance is good<br>Energy saving performance is bad |

First, the evaluation result of the case where only the toner 1 was used is the same as that in FIG. 3 in Embodiment 1, and hence the description thereof will be omitted. While each of the present embodiment and Comparative Example 3 obtains desired fixing performance and desired power consumption, Comparative Example 4 consumes redundant power.

Figure 6:
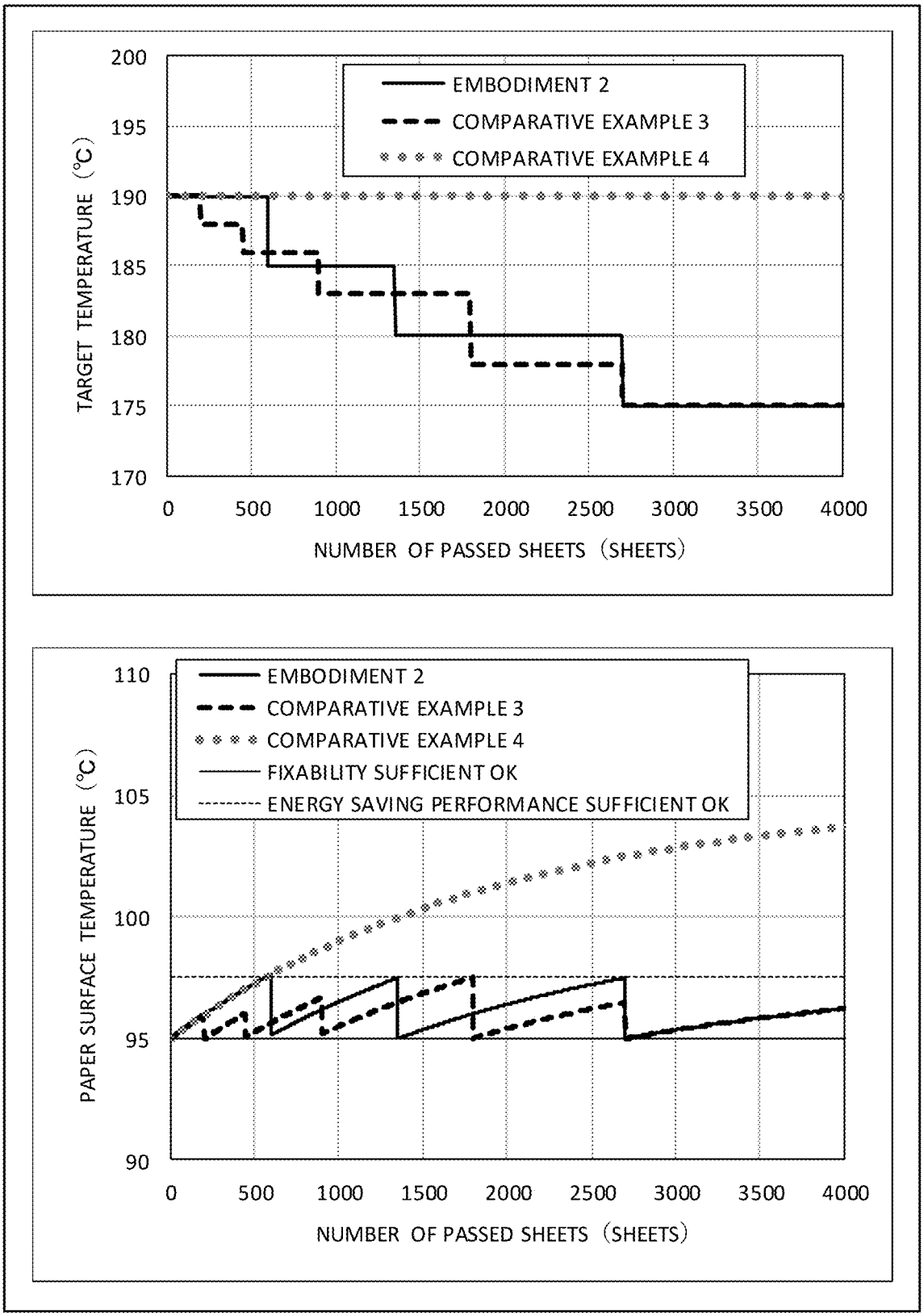
FIG. 6 shows the changes of the target temperature and the paper surface temperature in the case where toner 2 is used.

Next, the evaluation result of the case where only the toner 2 was used will be described by using FIG. 6. First, in Comparative Example 4, the target temperature is 190° C. and is constant. In this case, the change of the paper surface temperature is gentler than in FIG. 4 of the case where only the toner 1 was used and the thin paper 2 was passed. This is because the target temperature is lower than that in the case where the thin paper 2 is used with the toner 1, and hence the viscosity of the sliding grease layer 140 is higher, and it takes longer for the sliding grease layer 140 to become thin to increase the fixing performance.

Figure 7:
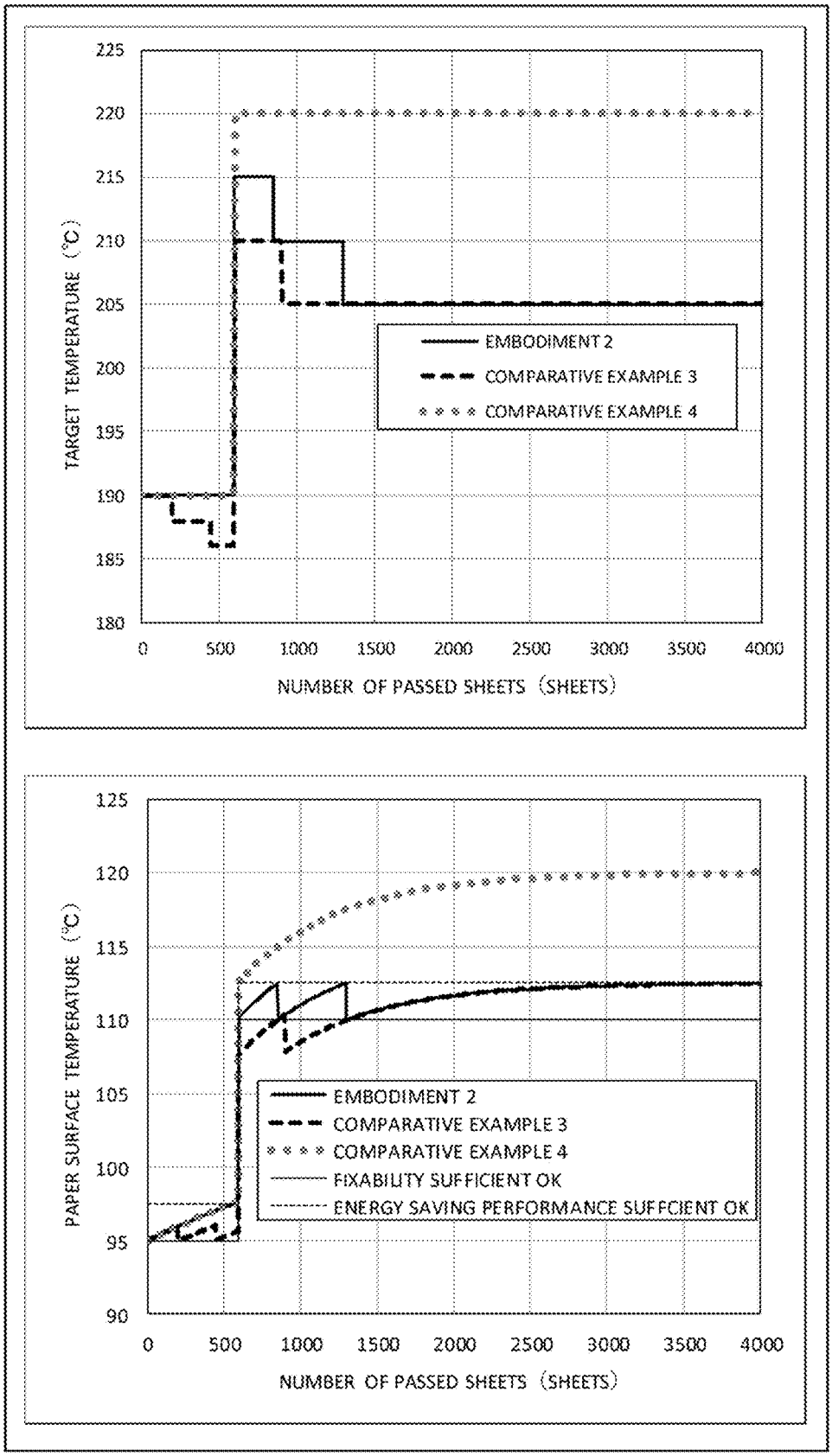
FIG. 7 shows the changes of the target temperature and the paper surface temperature in the case where toner 1 and toner 2 are used in this order.

Note that, in the case where the toner 2 is used, the paper surface temperature for preventing the occurrence of the Lastly, the case where the toner 2 was used until the number of passed sheets reached 600 and, thereafter, the toner 1 was used will be described by using FIG. 7. First, in Comparative Example 4, the target temperature is 190° C. and is constant until the number of passed sheets reaches 600, and becomes 220° C. at the time when the number of passed sheets becomes 601 as the result of reflecting the content of the storage portion which stores information on the toner 1. Similarly to the example in FIG. 6, the change of the paper surface temperature is gentle until the number of passed sheets reaches 600 and, at the time when the number of passed sheets becomes 601, the target temperature rises, and hence the change of the paper surface temperature is steep. The paper surface temperature for preventing the occurrence of the faulty fixing with the toner 1 is not less than 110° C., and hence, similarly to the previous example, power consumption is redundant.

Next, the present embodiment will be described. In the present embodiment, the change similar to that of the example in FIG. 6 is displayed until the number of passed sheets reaches 600, and the target temperature is 190° C. At the time when the number of passed sheets becomes 601 or later, in the case of the toner 2, when the total sum of the addition values exceeds the threshold value 1 which is 20000, the target temperature is corrected to 185° C., as shown in Table 3. However, when the toner is switched to the toner 1 at the time when the number of passed sheets becomes 601 or later and the total sum of the addition values in the counter exceeds the threshold value 1 which is 20000, the target temperature is not change to the target temperature of 185° C. used when the threshold value 1 in the case of the toner 2 is exceeded. In this case, instead of 185° C. which is the correction control temperature in the case where the toner 2 is used, the target temperature is changed to 215° C. which is a temperature corrected based on a difference between the initial target temperatures (the first initial control temperature and the third initial control temperature) in the case of the toner 1 and in the case of the toner 2. Note that 215° C. is a temperature when the initial target temperature (initial control temperature) of 220° C. is corrected by Δ−5° C. when the threshold value 1 in the case of the toner 1 is exceeded. 215° C. corresponds to a third correction control temperature. Based on the foregoing, the target temperature is changed from 190° C. to 215° C. Thereafter, the correction responding to the increase of the fixing performance of the fixing apparatus is applied, and hence the paper surface temperature is appropriately controlled in a range of 110° C. to 112.5° C.

In Comparative Example 3, the proper paper surface temperature is maintained until the number of passed sheets reaches 600, but the addition value to the counter is not changed. Accordingly, when the toner to be used is switched to the toner 2 when the number of passed sheets reaches 601, the target temperature is corrected to 210° C. which is the target temperature in the case where the toner 1 is used and the threshold value 2 is exceeded. As a result, the paper surface temperature becomes lower than 110° C., and the faulty fixing occurs. This is because, irrespective of the fact that the toner 2 is used until the number of passed sheets reaches 600, sheets are passed at a low target temperature, and the increase of the fixing performance is gentle, the threshold value in the case where only the toner 1 is used is used when the paper to be used is switched to the ordinary paper. Similarly, the correction which changes the target temperature to 205° C. when the number of passed sheets reaches 901 is an excessive correction, and the paper surface temperature becomes lower than 110° C.

As described thus far, in the case where the target temperature which differs depending on the toner to be used is used, while the correction of the target temperature is performed according to the number of passed sheets of the recording material in the fixing apparatus, the threshold value corresponding to the number of passed sheets which is used to perform the above correction is changed. With this, it is possible to properly reflect the change of the performance of the fixing apparatus to appropriately maintain the fixing performance and the energy saving performance. Note that, similarly to Embodiment 1, the correction of the target temperature has been described by using, as the example, the case where continuous paper passage, i.e., continuous heating in which the image formed on the recording material is continuously heated is performed, but the correction of the target temperature is not limited thereto. For example, also in the case where the sheets of the recording material are passed one by one at regular intervals, the number of passed sheets of the recording material is counted with the counter by adding up the passed sheets and, when the total sum of the addition values exceeds a predetermined threshold value, the correction of the target temperature is performed in the same manner as in the case where the image on the recording material is continuously heated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-236757, filed on Dec. 18, 2018, which is hereby incorporated by reference herein in its entirety.

What is claimed is:

1. An image forming apparatus comprising:

an image forming portion that forms an image on a recording material;

an image heating portion including a heater, the image heating portion using heat of the heater to heat the image;

a temperature detecting element that detects a temperature of the heater;

a control portion that controls power supplied to the heater based on the temperature detected by the temperature detecting element; and an acquisition portion that acquires the number of sheets of the recording material which has been passed through the image heating portion;

wherein the control portion has a plurality of operation modes which have different initial control temperatures each of which serves as a control target temperature for controlling the power and which is predetermined, and have different addition values each of which is used when the acquisition portion acquires the number of sheets and which is set for each sheet, wherein, among the plurality of operation modes, in a first operation mode in which the initial control temperature is a first initial control temperature and the addition value is a first addition value, the control target temperature is changed to a first correction control temperature obtained by correcting the first initial control temperature when the total sum of the first addition value exceeds a predetermined threshold value, wherein, when the operation mode is changed from the first operation mode to a second operation mode in which the initial control temperature is a second initial control temperature different from the first initial control temperature and the addition value is a second addition value different from the first addition value, the control target temperature is changed to a second correction control temperature obtained by correcting the first correction control temperature based on a difference between the first initial control temperature and the second initial control temperature.

2. An image forming apparatus comprising:

an image forming portion that forms an image on a recording material;

an image heating portion including a heater, the image heating portion using heat of the heater to heat the image;

a temperature detecting element that detects a temperature of the heater;

a control portion that controls power supplied to the heater based on the temperature detected by the temperature detecting element;

an acquisition portion that acquires the number of sheets of the recording material which has been passed through the image heating portion; and a cartridge including an accommodating portion that accommodates a toner for forming the image on the recording material, and a storage portion that stores information on the toner accommodated in the accommodating portion;

wherein the control portion has a plurality of operation modes which have different initial control temperatures each of which serves as a control target temperature for controlling the power and which is predetermined, and have different addition values each of which is used when the acquisition portion acquires the number of sheets and which is set for each sheet, wherein, among the plurality of operation modes, in a first operation mode in which the initial control temperature is a first initial control temperature and the addition value is a first addition value, the control target temperature is changed to a first correction control temperature obtained by correcting the first initial control temperature when the total sum of the first addition value exceeds a predetermined threshold value, wherein, when the cartridge is replaced during an operation in the first operation mode, the initial control temperature is changed from the first initial control temperature to a second initial control temperature stored in the storage portion of the cartridge after the replacement, the addition value is changed from the first addition value to a second addition value stored in the storage portion of the cartridge after the replacement, and the control target temperature is changed to a second correction control temperature obtained by correcting the first correction control temperature based on a difference between the first initial control temperature and the second initial control temperature.

3. An image forming apparatus comprising:

an image forming portion that forms an image on a recording material;

an image heating portion including a heater, the image heating portion using heat of the heater to heat the image;

a temperature detecting element that detects a temperature of the heater;

a control portion that controls power supplied to the heater based on the temperature detected by the temperature detecting element;

an acquisition portion that acquires the number of sheets of the recording material which are passed through the image heating portion; and a cartridge including an accommodating portion that accommodates a toner for forming the image on the recording material, and a storage portion that stores information on the toner accommodated in the accommodating portion;

wherein the control portion has a plurality of operation modes which have different initial control temperatures each of which serves as a control target temperature for controlling the power and which is predetermined, and have different addition values each of which is used when the acquisition portion acquires the number of sheets and which is set for each sheet, wherein, among the plurality of operation modes, in a first operation mode in which the initial control temperature is a first initial control temperature and the addition value is a first addition value, the control target temperature is changed to a first correction control temperature obtained by correcting the first initial control temperature when the total sum of the first addition value exceeds a predetermined threshold value, wherein, when the operation mode is changed from the first operation mode to a second operation mode in which the initial control temperature is a second initial control temperature different from the first initial control temperature and the addition value is a second addition value different from the first addition value, and the cartridge is replaced, the control target temperature is changed to a second correction control temperature obtained by correcting the first correction control temperature based on a difference between the first initial control temperature and the second initial control temperature, the second correction control temperature is changed to a third correction control temperature by further correcting the second correction control temperature based on a difference between the second initial control temperature and a third initial control temperature stored in the storage portion of the cartridge after the replacement, and the addition value is changed from the second addition value to a third addition value stored in the storage portion of the cartridge after the replacement.

4. The image forming apparatus according to claim 1, wherein one of the plurality of operation modes is prepared for each type of the recording material or for each transport speed of the recording material.

5. The image forming apparatus according to claim 1, wherein the image heating portion includes:

the heater for heating the image formed on the recording material;

a film which moves while sliding on the heater;

grease which is provided between the heater and the film; and a pressure member which presses the recording material against the heater via the film.

* * * * *